United States Patent [19]

Dombrowski

[11] 4,179,068

[45] Dec. 18, 1979

[54] LIQUID SPRAY DEVICES

[75] Inventor: Norman Dombrowski, Leeds, England

[73] Assignee: National Research Development Corporation, London, England

[21] Appl. No.: 926,335

[22] Filed: Jul. 20, 1978

Related U.S. Application Data

[63] Continuation of Ser. No. 708,735, Jul. 26, 1976, abandoned.

[30] Foreign Application Priority Data

Jul. 24, 1975 [GB] United Kingdom ..... 31000/75

[51] Int. Cl.[2] ..... B05B 1/24

[52] U.S. Cl. ..... 239/13; 239/129; 239/290

[58] Field of Search ..... 239/129, 132, 135–137, 239/139, 288.5, 290, 291, 403, 424, 13

[56] References Cited

U.S. PATENT DOCUMENTS

| | | | |
|---|---|---|---|
| 1,177,028 | 3/1916 | Fisher | 239/139 |
| 2,554,829 | 5/1951 | Jeurling | 239/424 X |
| 2,644,717 | 7/1953 | Kopperschmidt | 239/290 |
| 2,835,533 | 5/1958 | Baker | 239/129 X |
| 2,912,064 | 11/1959 | Friedell | 239/424 X |
| 3,017,121 | 1/1962 | Carlson | 239/129 |
| 3,198,434 | 8/1965 | Svrchek et al. | 239/291 X |
| 3,425,407 | 2/1969 | Furman et al. | 239/129 X |
| 3,516,608 | 6/1970 | Bowen et al. | 239/135 X |
| 3,969,842 | 7/1976 | Velie | 239/136 X |

*Primary Examiner*—Robert W. Saifer

*Attorney, Agent, or Firm*—Cushman, Darby & Cushman

[57] ABSTRACT

Liquid spray devices are known in which a liquid is emitted from an orifice in the form of a thin sheet of the liquid which subsequently breaks down to form droplets but normally the spray contains very many droplets of very small size which are subject to drifing in cross winds. In this invention means are provided to subject the spray sheet itself to atmospheric environmental conditions such that the sheet breaks down nearer its point of origin and the tendency is for droplets of greater size to be formed with consequent lower tendency to drift. In carrying out the invention hot gases can be released in the environment of the spray sheet and suitable gases can readily be obtained from combusted gases, possibly from the exhaust of the engine of a tractor towing the device.

13 Claims, 9 Drawing Figures

LIQUID SPRAY DEVICES

This is a continuation of U.S. application Ser. No. 708,735 filed July 26, 1976, now abandoned.

This invention relates to liquid spray devices and more particularly to those devices in which liquid is emitted from an orifice in the form of a thin sheet which subsequently breaks down to form droplets. The sheet can be in flat form, for example fan shape, or of conical shape. Generally, in known spray devices, the liquid sheet interacts with the surrounding atmosphere and waves are produced which grow to critical amplitudes with the result that there is a random fragmentary disintegration yielding a spray with a wide spectrum of drop sizes but generally there are large numbers of small droplets. Such small droplets are very easily dispersed in a moving atmosphere and, especially in the case of agricultural sprays when the liquid is highly likely to consist of or to contain materials such as toxic chemicals or fertilisers, such dispersal can cause serious drifting of these materials out of control of the operator.

Many attempts have been made to design spray nozzles or to produce liquid formulations to minimise this danger of drift but the present invention makes another contribution to environmental pollution control by aiming at controlling the minimum droplet size and/or the numbers of small droplets.

Although emphasis is laid, herein, particularly on liquid spraying for agricultural and/or horticultural purposes, it is envisaged that the invention may be of use under any conditions when control of sprayed drop size is paramount.

In accordance with the invention, in a spray device of the kind aforesaid, the liquid spray is arranged to be subjected to atmospheric environmental conditions such that break-down of the sheet occurs at an early stage and inherently the tendency is for droplets to be formed of size with little normal tendency to drift at least in lightly moving atmospheres.

The present disclosure is to be read as including the subject matter of the appended claims.

The right environmental conditions may be produced within a hot gaseous atmosphere and such atmosphere may, for example, be formed by the combustion of a fuel. However, it is possible that suitable conditions may be produced in an atmosphere which is derived from use of a gas of lower density than the surrounding air; helium and hydrogen are, of course, lighter gases but possibly the same effect may be obtained by using a supply of gas, such as atmospheric air, which has been heated by heat exchange or other means. It appears to be advantageous to have present water vapor present in the atmosphere and it may be that charged species may have some effect. Combusted fuel does contain certain charged species and in the case of an agricultural spray device, a convenient source of hot gases could be the exhaust from the engine of a tractor on which the spray device may be mounted or by which the spraying machine is being towed. It is not positively certain, however, at this stage that the presence of the charged species is necessary.

It is believed that the wave growth in the sheet of liquid is inhibited by use of the invention. It has been observed that, when hot combustion gas, i.e. probably a mixture of gases including water vapor, is present, breakdown of the sheet appears to take place very close to the nozzle, much closer than when operating with the nozzle without the atmospheric environmental control. The rapid breakdown of the sprayed sheet is additionally advantageous in that sprays may be produced at lower pressures than would be necessary to produce a useful spray otherwise. Thus, whereas for a standard nozzle it has been usual for pressures of 30 psig to be necessary, effective spraying, with the additional advantages offered by use of the invention, has been achieved with pressures of only 20 psig and even below.

A suitable atmosphere may be introduced to the vicinity of the spray by ducting which is external to the spray held, by leading hot gas to a shroud for the spray head, or by leading it through the spray head itself to permit it to emerge with the spray; in the case of a conical spray, the introduction may be through a passage extending into the centre of the spray, or the hot gas may be ducted through the spray itself to enter into the centre of the spray. Other alternatives will be readily apparent. It will also probably be found that it is desirable to have water vapour present in the hot gas supply. Another possibility is the use of steam in place of the hot gas.

Convenient arrangements in accordance with the invention are illustrated by way of example in the accompanying diagrammatic sectional drawings. In the design of these arrangements, standard spray nozzles, such as the 'Blue' fertilizer nozzle or the 'Green' herbicide nozzle, supplied by J. W. Chafer Limited have been particularly in mind. In the drawings.

Figure 6:
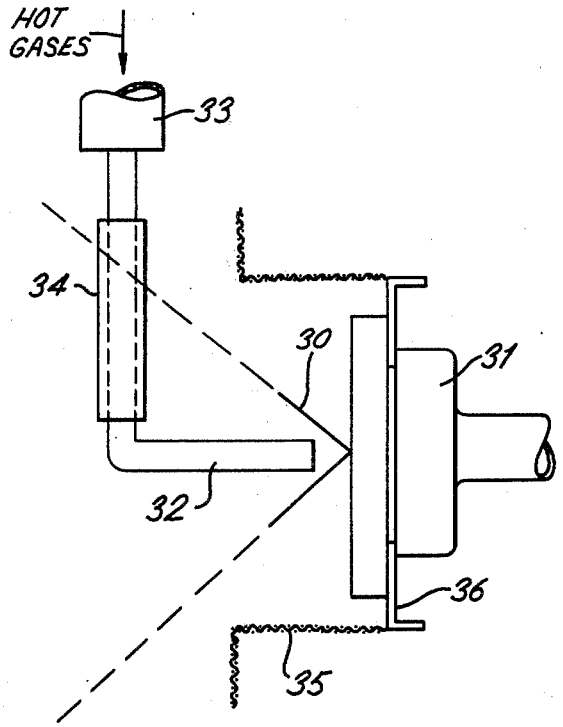
Figure 5:
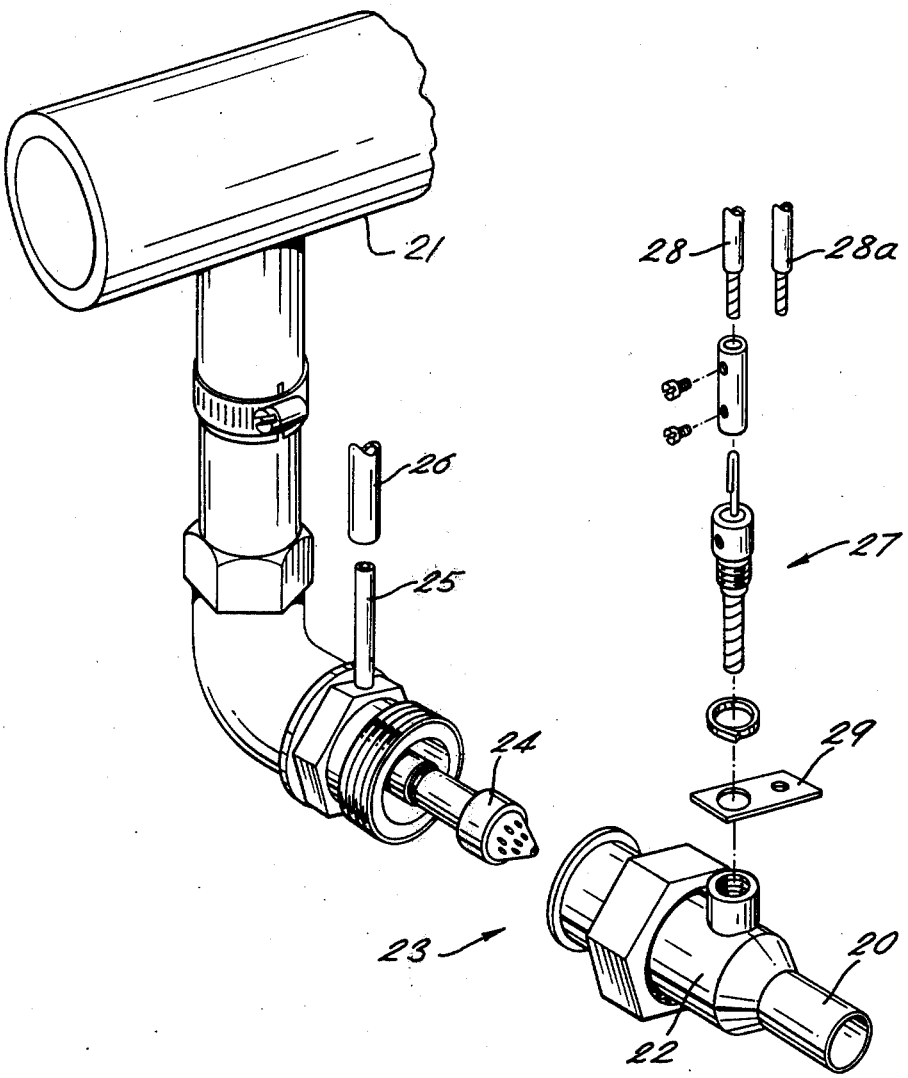

FIG. 5 includes a partly exploded view of a form of hot gas generator suitable for use in combination with the spray bar of standard spraying equipment; and FIG. 6 illustrates a combination of swirl nozzle and hot gas delivery to the interior of the conical spray sheet. This version is particularly suited to spraying from airborne equipment.

Figure 7:
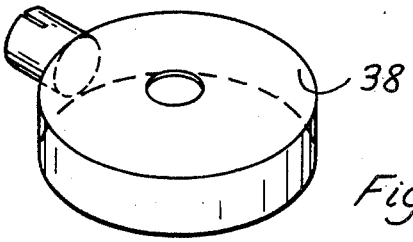
Figure 8:
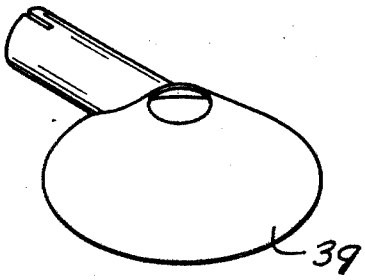
Figure 9:
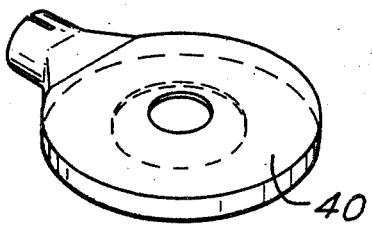

FIGS. 7 to 9 show various forms of shrouds for attachment to spray nozzles for the purpose of directing hot gas from a supply tube into the environment of the spray sheet.

In each of the examples shown in FIGS. 1 to 4, the spray head 1 comprises a nozzle in an end wall 2 of which a suitably shaped orifice 3 is formed and from the outer edge of the orifice a thin conical sheet 4 of liquid is emitted as the result of the disposition of swirl slots 5 which lead the liquid from the supply chamber 6 to the swirl chamber 7.

Figure 1:
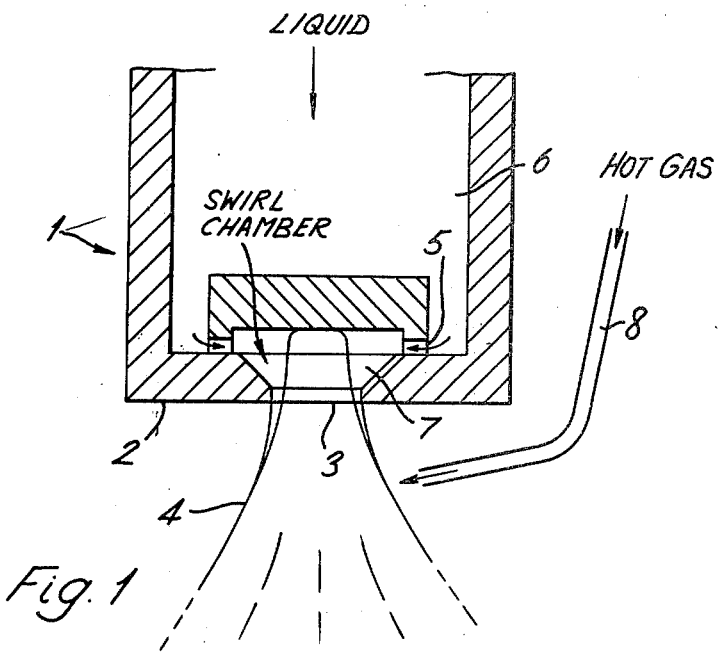
FIG. 1 shows a spray head incorporating a swirl nozzle with externally supplied hot gas atmosphere.

In the case of FIG. 1, hot combustion gas is led to the spray through a tube 8. In one particular example of this embodiment it has been found that successful spraying with acceptable drift control can be achieved with gases from a methane burner emerging at a temperature of the order of 300°–400° C. and at a spraying pressure of about 20 psig or less using a standard nozzle. Such an arrangement is particularly suited for use on a multi-spray boom for mounting on a tractor, or on an aircraft with possibly necessary screening from wind currents, since a pipe could be provided having the requisite number of hot gas tubes extending from it.

For example, as illustrated in FIG. 5, a hot gas outlet 20 may be associated with a common supply pipe 21, from which air supplies can be taken at different points for association with gas outlets for each spray jet. The outlet 20 is formed on a combustion chamber portion 22 of a burner 23 comprising a propane pilot jet 24 (Size No. 6, Model 2001). Propane is fed through inlet tube 25 connected by flexible tubing 26 to a supply of the liquefied propane which may take the form of a standard domestic container. The burner is completed by the igniter 27 which is energised by current through the wires 28, 28*a*, the latter of which is earthed to the burner body through the metal strip 29. Other gases may, of course, be used for the burner and gauzes may be found to be necessary upstream and/or downstream of the burner jet.

Then hot gas outlet 20 may be arranged to play onto the outside of a spray sheet as indicated by FIG. 1.

Care should be taken that the gas velocity does not reach values such that the spray sheet is deformed because, in that case, the small droplets will tend to reappear. Where spraying with a standard nozzle at 20 psig or less, it was found to be desirable for the maximum gas velocity to be about 4 meters per second. It may be formed desirable to surround the spray sheet with a hood such as shown in any one of FIGS. 7 to 9 by the numerals 38, 39 and 40, respectively. As shown each form of hood has a radially extending connecting tube and has a hole by the edge of which the hood is secured to the spray nozzle. In FIG. 7 the hood comprises a flat circular disc with an edge flange at right angles to the disc. It will be understood that the edge flange can be deeper. In FIG. 8 the hood is of conical shape and in FIG. 9 there are two flat discs, the hole in the disc opposite to the spray nozzle fixation being of larger diameter to surround the spray sheet.

As an alternative adaptation of the arrangement indicated in FIG. 1, the pipe 8 could be connected to a common feeder into which the exhaust system of a tractor engine or of an aircraft engine could vent. Such common feeder can be a pipe which is adapted to be swung into position as required and may form an integral structure with a spray bar for the purpose. It appears that careful attention should be paid to ensure that the thermal insulation of such a feeder and its connections and interconnections is adequate. Heat insulation would be of even greater importance if the spray bar were to be mounted on a purpose-built spraying machine which has to be towed by a tractor; the length of piping would therefore have to be increased compared with an arrangement of a tractor-borne spray bar.

Provision will probably be required for the injection of water or water vapor into the exhaust gas stream particularly in view of the rather lean fuel-air mixtures generally employed in diesel engines for a tractor.

Figure 2:
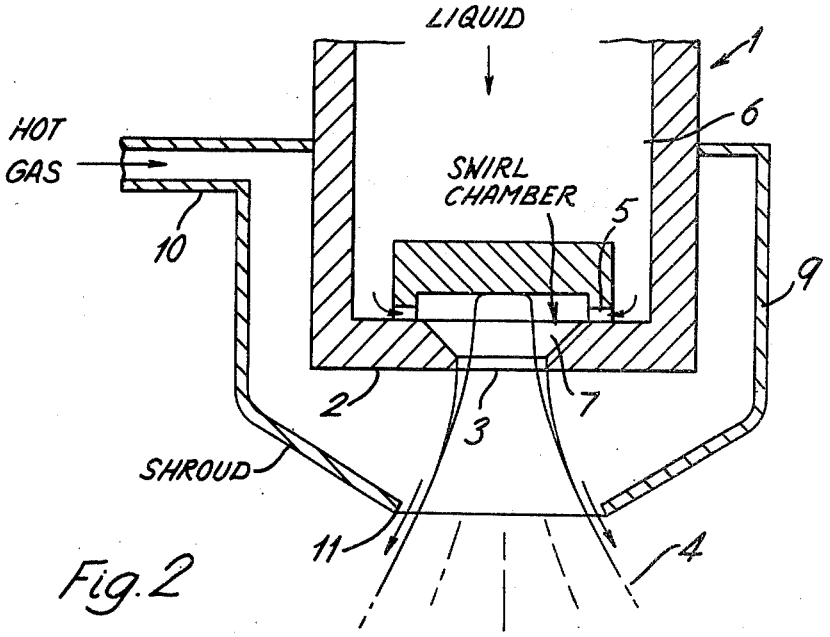
FIG. 2 shows a similar kind of spray head with enveloping shroud for the supply of hot gas atmosphere.

In the arrangement of FIG. 2, the head 1 is shrouded by the shroud member 9 which engages the outer wall of the spray head and has a supply connection 10 for the supply of hot combustion gas to the space between the shroud and the head. The gas emerges through the opening 11, which is of diameter commensurate with the size of the spray 4 at the particular point. This shroud member 9 is somewhat similar in effect to that shown in FIG. 9 described below but has provision for deeper insertion of the head of the spray nozzle.

Figure 3:
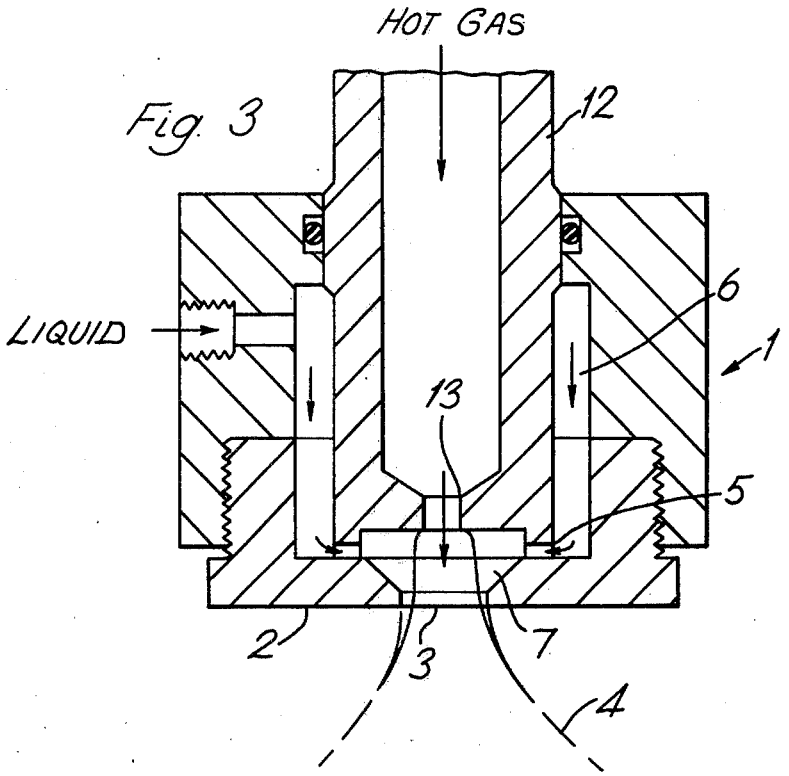
FIG. 3 shows a different form of spray head with internal supply arrangements for the hot gas atmosphere.

In the arrangement of FIG. 3, a duct 12 is provided within the head 1; the outlet 13 from the duct in this arrangement allows hot combustion gas to be introduced within the bounds of the spray sheet 4. It will be appreciated that in this configuration the outlet 13 will probably only pass very small quantities of hot gas and this may be limiting for certain applications.

Figure 4:
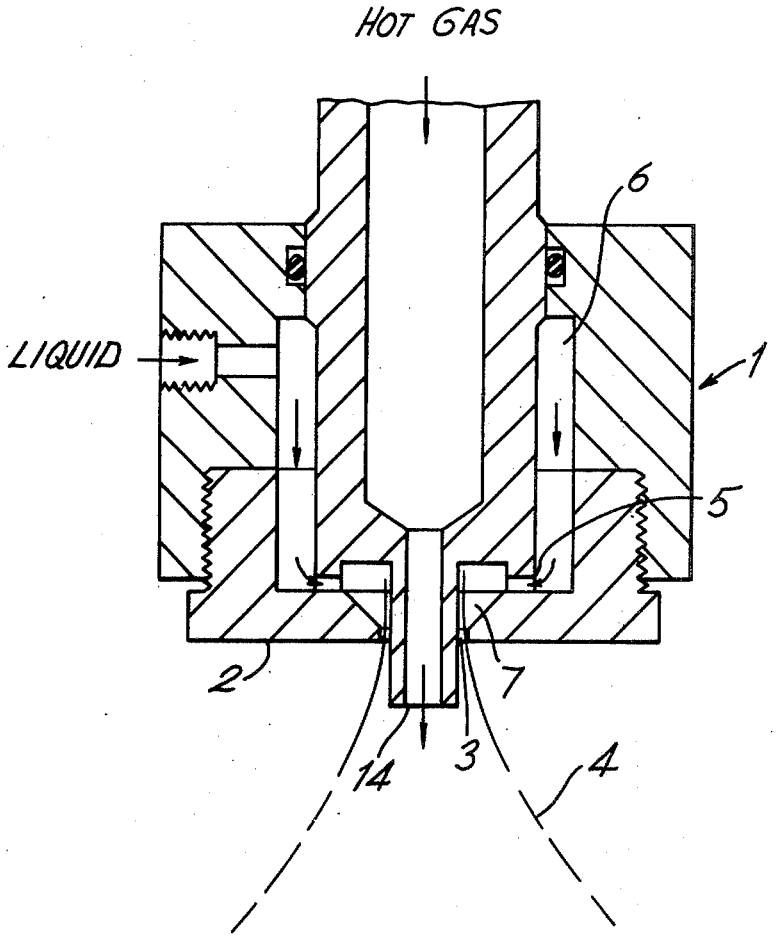
FIG. 4 shows a similar form of spray head to that shown in FIG. 3, but with internal hot gas ducting permitting a hot gas atmosphere to emerge within the spray sheet.

The arrangement of FIG. 4 is similar to that shown in FIG. 3 but the outlet 14 from the duct 12 is extended through the spray orifice 3 so that the hot combustion gas emerges within the space bounded by the spray sheet. In this arrangement, one or more slots may be provided at the end of the outlet 14 to deflect the stream of gases directly on to the spray sheet but it should be understood that this may not be necessary since breakdown of the sheet may be obtained without direct deflection. The same consideration applies to the size of the outlet as with the arrangement of FIG. 3 and this, again, may be a limitation for certain applications.

Although reference has been made above, generally, to airborne spraying equipment embodying the invention, one embodiment which is specifically useful for that use will be seen to be illustrated in FIG. 6 of the accompanying drawings.

In FIG. 6, the conical spray sheet 30 is shown emerging from the nozzle 31 and this embodiment a tube 32 connects with a burner outlet 33. The tube 32 passes through the spray sheet and, if desired, a heat insulating ceramic covering tube 34 may be provided but, being relatively small, even with the insulating cover, little effect is evident on the efficiency of the spray. The insulation will avoid undue cooling of the hot gases which emerge from the end of the tube 32 into the interior of the spray sheet. In order to avoid the tendency of the spray liquid to coalesce on the insulator and to form large drops, the insulator can be shaped to present a less bluff surface to the spray, as will be apparent. Alternately the tube 32 may be formed with a longer portion extending axially of the spray sheet so that penetration of the sheet takes place at a greater distance from the nozzle. Yet again, merely coating the insulator with a non-wettable surface may be satisfactory.

Possibly due to a certain degree of screening of the outlet of the tube 32 from the effect of eddies caused by strong air currents moving in the direction of spraying, it may be found that such an arrangement will be satisfactory for mounting on an airborne spray bar. However, if necessary, additional screening may be provided by a shroud 35 carried by the nozzle head 31. This shroud is shown in the drawing as of gauze supported by flanged disc 36 and in the configuration shown, with gauze of B.S. mesh size 29 and wires 0.010 in. diameter, the arrangement has enabled spraying to be effective in air currents equivalent to an air speed of about 110 miles per hour.

Charged species may be introduced if necessary, into a stream of gas by directing the stream through an electric spark discharge or in the neighbourhood of an electric arc. Further means of introducing charged species will be apparent as will other possible embodiments of the invention.

It may be possible that the temperature of the gas, referred to as hot, need be a matter of only a few degrees, say 30° to 40° C., above that of the immediate environment of the nozzle in some instances. However, it seems that a minimum temperature of about 50° C. is required but this will become apparent without difficulty in any particular use of the invention.

I claim:

1. A device for spraying liquid in droplet form through a first and movable atmosphere onto receiving surfaces and for reducing the quantity of small sized droplets relative to a spectrum of droplet sizes sprayed by the device to reduce the tendency of the droplets to be disturbed by air currents, said device comprising:

an orifice;

means to emit only liquid from said orifice in the form of a non-atomized thin sheet of a kind that, in the absence of further treatment, breaks down after a time interval within said first atmosphere into droplets falling within a spectrum of sizes;

means to contact said sheet close to said orifice and before said sheet breaks down with a second atmosphere comprising hot gas, whereby said time interval is shortened and the proportion of small droplets is diminished, and outlet means for discharging said liquid from said device to proceed toward said receiving surfaces.

2. A liquid spray device as claimed in claim 1, wherein said hot gas is derived from combustion of a fuel.

3. A liquid spray device as claimed in claim 2, wherein a fuel burner is provided for the local combustion of the fuel for the individual spray sheet.

4. A liquid spray device as claimed in claim 2, wherein the device is mounted on a vehicle having a combustion and ducting is provided to lead at least a portion of the exhaust gas from the engine for said vehicle to the environment of the spray sheet.

5. A liquid spray device as claimed in claim 1, wherein said outlet means is a shroud which is provided for at least the initial portions of the spray sheet.

6. A liquid spray device as claimed in claim 5, wherein the shroud has a flanged disc shape.

7. A liquid spray device as claimed in claim 5, wherein the shroud has its flange in the form of a member which approaches in shape closely to the outer surface of the spray sheet.

8. A liquid spray device as claimed in claim 5, in which the spray sheet is conical, said device being capable of use for airborne spraying equipment, wherein said means to contact is positioned to deliver hot gas within the bounds of the spray sheet and said shroud operates to protect those initial portions of the spray sheet from currents of air directed substantially parallel to the axis of the spray sheet.

9. A liquid spray device as claimed in claim 1 and in which the spray sheet is conical, wherein said means to contact is positioned to deliver hot gas within the bounds of the spray sheet.

10. A liquid spray device as claimed in claim 9, wherein said means passes through the spray sheet.

11. A liquid spray device as claimed in claim 10, wherein heat insulation is carried by the portion of said means which passes through the spray sheet.

12. A device for spraying liquid on crops in droplet form through a first and movable atmosphere onto receiving surfaces and for minimizing the tendency of small sized droplets to form relative to the spectrum of droplet sizes emitted by the device so as to minimize the tendency of air currents to disturb the droplets, said device comprising:

an orifice;

means including a swirl chamber for emitting only liquid from said orifice in the form of a non-atomized thin sheet of a kind that, in the absence of further treatment, breaks down after a time interval within said first atmosphere into droplets falling within a spectrum of sizes;

means to contact said sheet close to said orifice and before said sheet breaks down into droplets with a second atmosphere comprising hot gas, whereby said time interval is shortened and the proportion of small droplets is diminished, and outlet means for discharging said liquid from said device to proceed toward said receiving surfaces.

13. A method of spraying a liquid in droplet form onto a receiving surface so as to reduce the tendency of the liquid to form small droplet sizes to thereby minimize the tendency of the air currents to disturb the liquid sprayed, comprising the steps of emitting the liquid from an orifice in the form of a thin sheet of a kind that, in the absence of further treatment, breaks down after a time interval within a first atmosphere into droplets falling within a spectrum of sizes; and contacting said sheet close to said orifice and before said sheet breaks down with a second atmosphere comprising hot gas wherein said time interval is shortened and the porportion of small droplets is diminished.

* * * * *